US009701002B2

(12) United States Patent
Raunisto

(10) Patent No.: US 9,701,002 B2
(45) Date of Patent: Jul. 11, 2017

(54) HAMMERING DEVICE

(71) Applicant: Yrjo Raunisto, Hameenlinna (FI)

(72) Inventor: Yrjo Raunisto, Hameenlinna (FI)

( * ) Notice: Subject to any disclaimer, the term of this patent is extended or adjusted under 35 U.S.C. 154(b) by 403 days.

(21) Appl. No.: 14/372,759

(22) PCT Filed: Jan. 18, 2013

(86) PCT No.: PCT/FI2013/000001
§ 371 (c)(1),
(2) Date: Jul. 17, 2014

(87) PCT Pub. No.: WO2013/107924
PCT Pub. Date: Jul. 25, 2013

(65) Prior Publication Data

US 2014/0345896 A1 Nov. 27, 2014

(30) Foreign Application Priority Data

Jan. 18, 2012 (FI) ..... 20120016

(51) Int. Cl.
*B25D 9/22* (2006.01)
*B25D 9/04* (2006.01)
(Continued)

(52) U.S. Cl.
CPC ..... *B25D 9/22* (2013.01); *B25D 9/04* (2013.01); *B25D 9/12* (2013.01); *E02D 7/10* (2013.01)

(58) Field of Classification Search
CPC ..... B25D 9/22; E21C 37/00
(Continued)

(56) References Cited

U.S. PATENT DOCUMENTS 4,103,591 A * 8/1978 Reiersdal ..... B25D 9/145 91/39
7,322,425 B2 * 1/2008 Keskiniva ..... B25D 9/125 173/1

(Continued)

*Primary Examiner* — Nathaniel Chukwurah
(74) *Attorney, Agent, or Firm* — Galbreath Law Offices, P.C.; John A. Galbreath

(57) ABSTRACT

Hammering device functioning with pressure fluid of a hydraulic arrangement which hammering device comprises a body (16), (19) which can be attached to a working machine on which machine a hammering mass (3) is adjusted to be resting and to be moving which hammering mass is moved into a hammering position with the help of hydraulic pressure by directing the pressurized fluid into the ring-shaped, first chamber space (6) wherein the hammering mass (3) when it is moving into a hammering position compresses gas in the chamber space (K1) located at the first side of the hammering mass (3) and in order to perform the hammering movement with the hammering mass (3) to the hammering element (5), (27) the flow of hydraulic pressure is blocked to the first chamber space (6) and the access for pressure fluid is allowed away from the first chamber space (6) with the help of the valve (2). In order to remove the pressure fluid fast from the first chamber space (6) the ring-shaped, second chamber space (7) is adjusted to be an extension for the first chamber space (6) and a ring-shaped valve (2) which comprises a closing ring is adjusted between the mentioned chamber spaces (6), (7) the port of which valve is formed of a group of holes which holes are located in the mentioned closing ring.

8 Claims, 3 Drawing Sheets

(51) Int. Cl.
*E02D 7/10* (2006.01)
*B25D 9/12* (2006.01)

(58) Field of Classification Search
USPC ..... 173/204, 208, 127, 206, 48; 91/218; 60/371
See application file for complete search history.

(56) References Cited

U.S. PATENT DOCUMENTS

| | | | | |
|---|---|---|---|---|
| 7,836,969 | B2 * | 11/2010 | Ahola | B25D 9/18 173/1 |
| 2006/0032649 | A1 * | 2/2006 | Keskiniva | B25D 9/22 173/213 |
| 2006/0157259 | A1 * | 7/2006 | Keskiniva | B25D 9/125 173/1 |

* cited by examiner

HAMMERING DEVICE

This invention relates to a hammering device functioning with pressure fluid of a hydraulic system which hammering device comprises a body which can be attached to a working machine on which machine a hammering mass is adjusted to be resting and moving which hammering mass is moved to a hammering position with the help of hydraulic pressure by directing the pressurized fluid to a ring-shaped, first chamber space in which case the hammering mass compresses the gas when it is moving to the hammering position in a chamber space which is located at the first side of the hammering mass and in order to perform the hammering movement with the hammering mass to the hammering element the flow of the hydraulic pressure to the first chamber space is blocked and the exit for the pressure fluid is allowed with the help of a valve from the first chamber space.

A rotating ring valve which is adjusted to a hydraulic hammering device is previously known from the publication SU 423922 in which publication the ring valve which rotates with a constant speed adjusts the stroke frequency of the hammering device. The stroke frequency can be adjusted by blocking ports with special pegs. The ring valve controls out/return flows of the pressurized liquid along pipings into a cylinder to the pressure face of the hammering piston. Gas which is compressed at the other side of the plunger performs the hammering work when the ring valve enables the removing of the liquid from the cylinder. Thus a pulsating movement can be created for the piston. The ring valve does not decrease the pressure losses being created in the pipings. During the hammering the liquid is removed from the cylinder along a channel system and causes pressure loss and weakens hammering efficiency.

In the publication FI116513 the ring valve functions as a closing and opening valve of the pressure channel in the hammering device. There is a control valve which is installed to be rotating in the hammering device which control valve comprises control channels in order to direct the pressure fluid periodically from the pressure fluid space to the return channel. In this solution the hammering movement is created by allowing the access from the pressure fluid space to the fluid container. The return piping causes a huge pressure loss because a fast hammering movement would demand fast flow rate of the liquid in a conventional return piping. With this solution an efficient hammering action cannot be achieved.

A rotating ring valve which is located in a vibrating device creating trembling is shown in the publication U.S. Pat. No. 4,317,406. The piston creating trembling moves in the cylinder when the direction of motion of the piston is being changed all the time with the help of the rotating ring valve. Because a pressure accumulator is not used in order to intensify the impacts of the piston, the flow resistance of the return channel is really not of significance.

The disadvantage of the above mentioned solutions is flow resistance caused by the liquid which is being removed from the front of the piston during the impact when the liquid must run through the piping into the fluid container. When a pressure accumulator is used in order to intensify the impacts, the liquid should run in the return pipe 10, even 20 times faster in relation to the normal flow rate. This is nearly impossible and the consequence is that one cannot reach the impact velocity which potentially could be gained.

With the hammering device according to the invention essential improvements can be achieved in relation to the known prior art and it is characteristic of the invention that in order to remove the pressure fluid fast from the first chamber space a second, ring-shaped chamber space has been adjusted to be an extension for the first chamber space and a ring-shaped valve, which comprises a closing ring, has been adjusted between the mentioned chamber spaces the port of which valve has been formed of a group of holes which are located in the mentioned closing ring in which case the pressure fluid is adjusted to move fast from the first chamber space to the second chamber space through the mentioned valve when the mentioned volumes of the chamber spaces are changing due to the movement of the hammering plunger.

The advantage of the invention is the fact that the counter pressure caused by the hydraulic fluid which is being removed fast from the cylinder can be nearly eliminated with the help of a new valve when the liquid can be directed immediately to the adjacent space through the holes of the valve. When the hammering mass is being moved to be ready for the impact, the hydraulic fluid is being removed through the pipeline but this removal does not need to be a sudden process. The new valve can be built in such a way that it functions fast and in spite of that all pressure impact effects which are created stay to be harmless in the chamber spaces of the device. The valve according to the invention can be used in the percussion hammers which hit in one direction, such as in breaking hammers for stones and in hammering devices which hit in two directions, such as in devices which hit poles into the ground and pull them up.

In the following the invention is described more detailed by referring to the accompanying drawings in which FIG. 1 shows a hammering device according to the invention as a side view when the outermost attachment body is opened.

Figure 1:
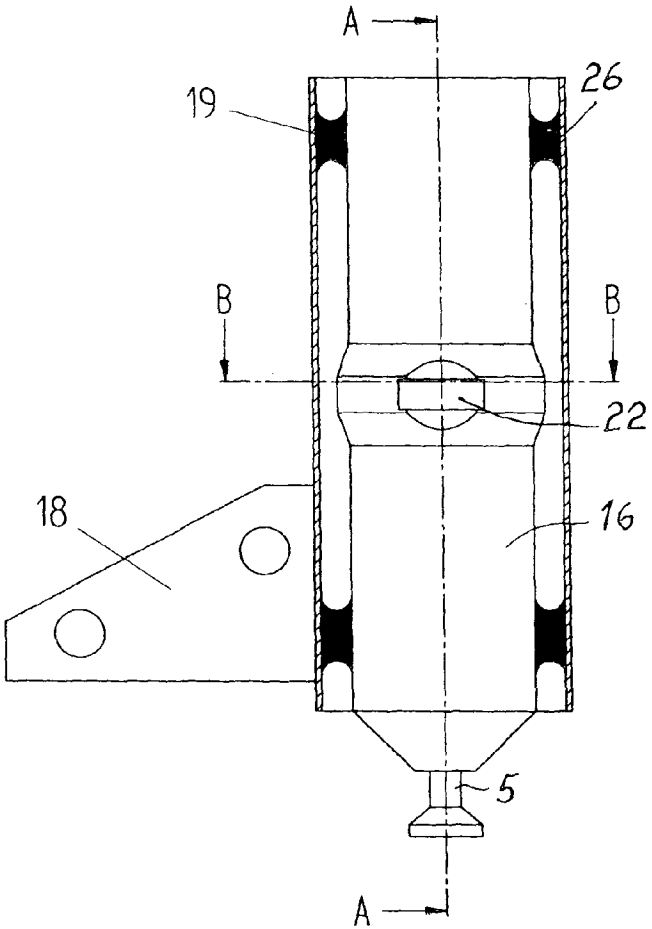

A hammering device which can be attached to a working machine with an attachment part 18 is shown in the FIG. 1 which hammering device comprises a attachment body 19 and a body of the hammering device 16 which is adjusted inside it with the help of a rubber damper 27.

Figure 2:
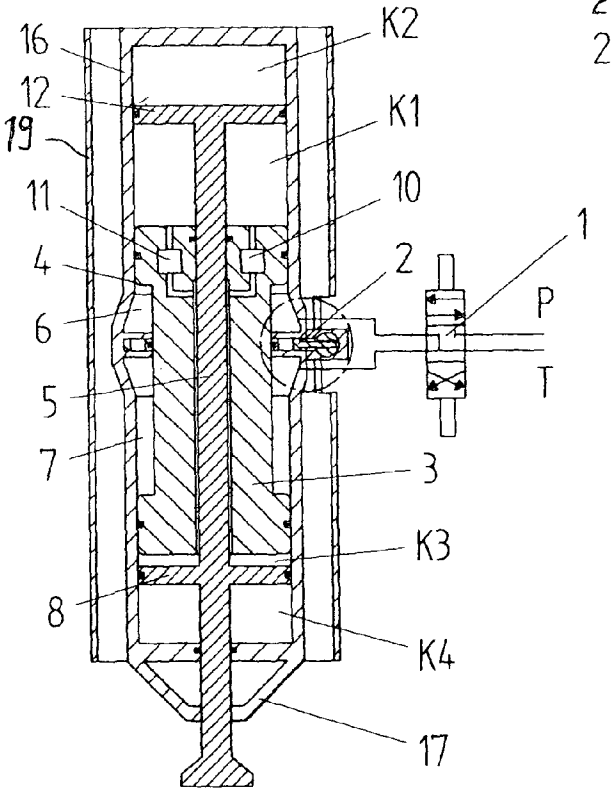
FIG. 2 shows the device of the FIG. 1 as a side view when the attachment body and cylinder body are opened.

The same hammering device is shown in the FIG. 2 as a section view in which case a cylindrical body of the hammering device 16 comprises a hammering piston 3 inside it as a hammering mass and it this case comprises a shaft bar 5 which is directed through a hammering piston 3 which shaft bar directs the impacts to be created out of the device. The hammering mass/piston 3 is sealed onto the inner surface of the body of the hammering device 16. A ring-shaped chamber space is formed for the side part of the hammering piston 3 by decreasing the size of the diameter which chamber space is divided into two chamber space 6 and 7 with the help of a valve 2 which is attached to the body of the hammering device 16. The shaft bar 5 comprises two flange parts 8 and 12 which are sealed onto the inner surface of the body of the hammering device 16 and the mentioned flanges 8, 12 divide the inner space of the body of the hammering device 16 further into chambers K1, K2, K3 and K4. These chambers can be filled with gas. Hydraulic pressure fluid is led in a controlled way into the chamber spaces 6 and 7 through a valve 1 and out of the chamber spaces as a return flow.

The hammering device functions as a unit which hits downwards by directing the pressure, which lifts the hammering piston 3 upwards, from the valve 1 to the chamber space 6. At the same time the pressure fluid is being allowed to burst out from the chamber space through a valve 1. When the hammering piston 3 is being lifted, the gas is compressed in the chamber K1 and at the same time also in the chamber K2 and also the shaft bar 5 rises a little bit. With the help of the working machine the hammering device is being pressed or it is let to be pressed against the target in such a way that the lower end of the shaft bar 5 will be attached to the target of the impact. With a regulated pressure of the chamber K1 the functioning of the valve 1 is changed to block the feeding into the chamber space 6. At the same time a ring-shaped valve 2 is being opened between the chamber spaces 6 and 7 in which case the pressure of the gas in the chambers K1 and K2 suddenly pushes the hammering piston 3 downwards and it hits the shaft bar to the flange 8. The valve 2 lets the hydraulic fluid to flow from a chamber space 6 which is suddenly getting smaller to a correspondingly expanding chamber space 7. A part of the hydraulic fluid returns through the valve 1 into the fluid container, but the largest part of the liquid moves through the valve 2 into the expanding chamber 7 which expands in the same proportion as the chamber 6 is getting smaller. The hammering piston 3 hits the flange 8 before the movement play of the hammering plunger 3 finishes. The device hits again when the hammering piston is being lifted up again with the help of the pressure which is directed to the chamber space 6.

The impacts upwards occur by being controlled with the valve 1 by directing the hammering piston 3 down with the help of a hydraulic pressure which is directed into the chamber space 7 in which case the hammering piston at the same time compresses the gases of the chambers K3 and K4 into a high pressure to be the loading energy for the impact. However before the changing of the hammering direction the gases of the chamber K1 must be led into the chamber K3 for the most part. This can be done by directing the hammering piston 3 so high and directing such a great pressure into the chamber K1 that the valve 10, which is adjusted to become open with a pressure which is greater than in normal use, becomes open and lets the most part of the gas of the chamber K1 into the chamber K3 from the side of the arm of the shaft bar 5. In this way the needed, greater gas volume is being changed into the chamber K3. When the hammering direction is being returned, the gas is being led correspondingly back into the chamber K1 through a valve 11 which is being opened with a certain pressure.

Figure 3:
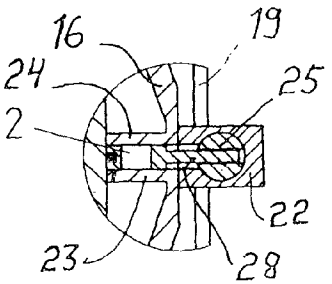
FIG. 3 shows the driving head of the valve as a section view.
Figure 4:
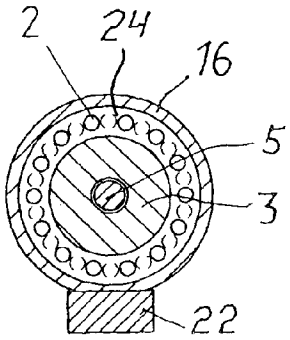
FIG. 4 shows the ring valve, a section view B-B.

The valve 2 according to the invention is shown in the FIGS. 3 and 4 which in this example is a valve which comprises a closing ring which is equipped with holes in which case the closing ring is being controlled by rotating it between two fixed rings 23, 24 which are attached to the body of the hammering device 16. In the fixed rings 23, 24 the holes are divided to have the same distance from each other as in the closing ring. The valve 2 is open when the closing ring is being rotated in such a way that the holes are at the same location. The valve 2 is closed by rotating the closing ring in such a way that the unbroken necks of the closing ring are at the location of the holes of the fixed rings.

The FIG. 4 shows the upper, fixed ring 24 which has holes (circles) which are shown with a unitary line. The holes of the closing ring—every second hole—are shown with dashed lines. The valve 2 is closed in the section view picture 4. The closing ring is being rotated with the help of a double action hydraulic cylinder 25 which is located in the part 22 which cylinder is adjusted to rotate the closing ring between the rings 23, 24 with the help of a arm 28. The sliding surfaces of all the rings are polished and are located against each other with an accurate fit in which case the leakages have been minimized. The opening of the valve can be performed quickly and the pressure shocks, too, are limited only at the surroundings of the valve.

Figure 5:
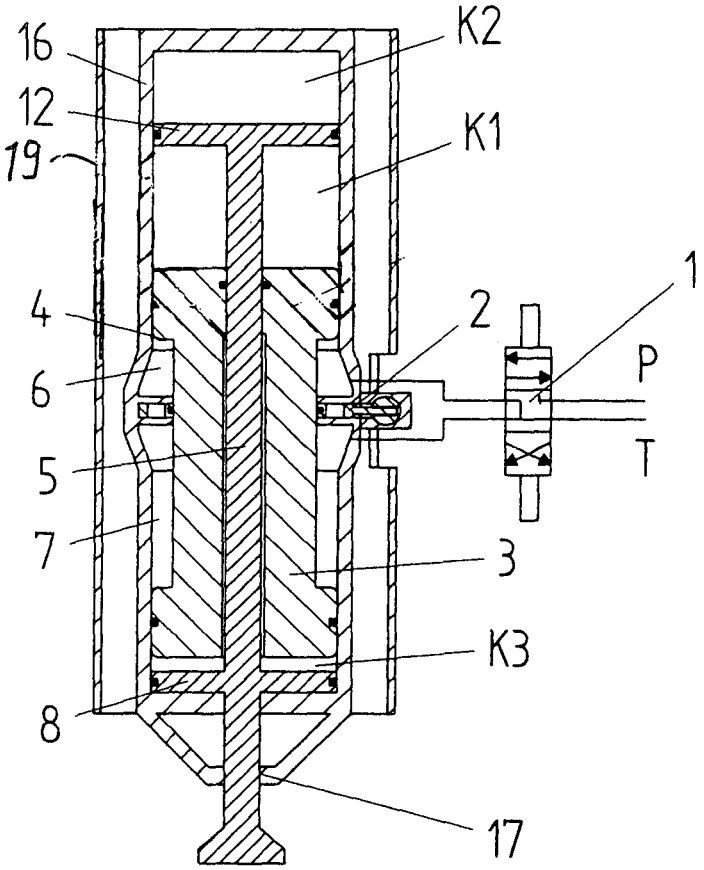
FIG. 5 shows a hammering device which hits in one direction as a section view.

FIG. 5 shows a device which is modified from the hammering device of the FIG. 2 and hits in one direction. The chambers K1 and K2 function as gas spaces. The valves 10 and 11 are not needed.

Figure 6:
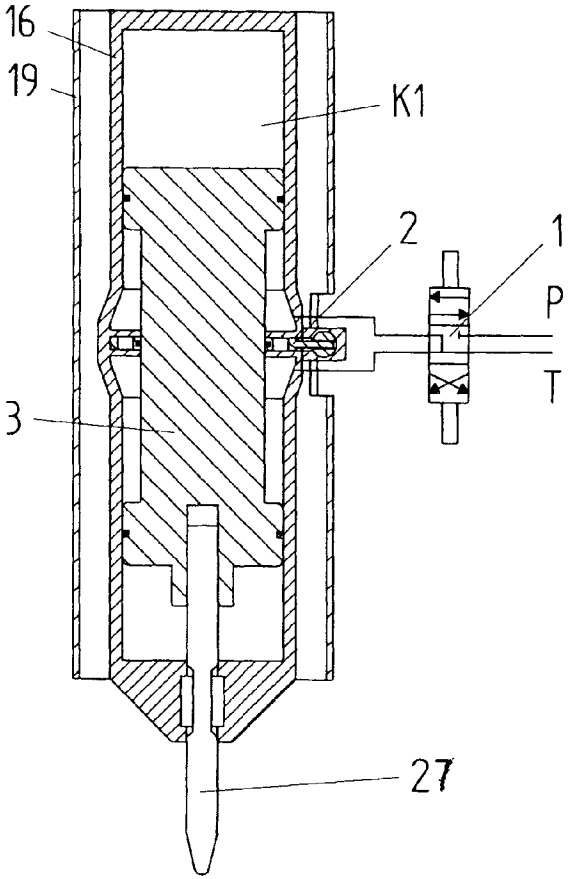
FIG. 6 shows another device which hits in one direction.

A percussion hammer which hits downwards is shown in the FIG. 6 to which percussion hammer a valve 2 according to the invention has been adapted. There are essentially less flow losses in the holes of the valve 2 during the hammering movement of the hammering piston 3 than in the known structures in which the liquid must be removed fast out of the cylinder through a piping and even the resistance of the valve is present. The hammering piston 3 hits directly to the tool 27.

The invention claimed is:

1. A hammering device which can be attached to a working machine, the hammering device comprising:

a body, a moving hammering piston inside the body, a hammering element, a gas filled chamber space at a first side of the hammering piston, a first ring-shaped chamber space around the hammering piston, a second ring-shaped chamber space around the hammering piston and axially in line with the first ring-shaped chamber space and a ring-shaped valve between the first ring-shaped chamber space and the second ring-shaped chamber space, the valve comprising a group of holes, whereby feeding pressure fluid to the first ring-shaped chamber space moves the hammering piston to a hammering position the hammering piston thereby compressing gas in the gas filled chamber space, thereafter blocking the feeding of the pressure fluid to the first ring-shaped chamber space and opening the valve allows the pressure fluid to flow from the first ring-shaped chamber space to the second ring-shaped chamber space thereby causing the hammering piston to perform a hammering movement to the hammering element and the movement of the hammering piston being arranged to change volumes of the first and second ring-shaped chamber spaces.

2. Hammering device according to the claim 1, characterized in that during the impact the second chamber receiving the pressure fluid expands in the same proportion as the first chamber is getting smaller.

3. Hammering device according to the claim 1, characterized in that the valve is an element which is attached to the body wherein the group of holes of which valve can be closed and opened by rotating a ring-shaped with holes equipped closing device to close and open said group of holes.

4. Hammering device according to the claim 1, characterized in that when the pressure fluid is being directed into the first chamber space, the valve stays closed and an exit is opened for the pressure fluid from the second chamber space.

5. A hammering device which can be attached to a working machine and which creates impacts in two directions, the hammering device comprising:

a body, a moving-hammering piston inside the body, a hammering element, a first gas filled chamber space at a first side of the hammering piston, a second gas filled chamber space at a second side of the hammering piston, a first ring-shaped chamber space around the hammering piston, a second ring-shaped chamber space around the hammering piston and axially in line with the first ring-shaped chamber space and a ring-shaped valve between the first ring-shaped chamber space and the second ring-shaped chamber spaces, the valve comprising a group of holes, whereby feeding pressure fluid to the first ring-shaped chamber space moves the hammering piston to a first hammering position the hammering piston thereby compressing gas in the first gas filled chamber space, thereafter blocking the feeding of the pressure fluid to the first ring-shaped chamber space and opening the valve allows the pressure fluid to flow from the first ring-shaped chamber space to the second ring-shaped chamber space thereby causing the hammering piston to perform a hammering movement to the hammering element, feeding pressure fluid to the second ring-shaped chamber space moves the hammering piston to a second hammering position the hammering piston thereby compressing gas in the second gas filled chamber space, thereafter blocking the feeding of the pressure fluid to the second ring-shaped chamber space and opening the valve allows the pressure fluid to flow from the second ring-shaped chamber space to the first ring-shaped chamber space thereby causing the hammering piston to perform a hammering movement to the hammering element, and the movement of the hammering piston being arranged to change volumes of the first and second ring-shaped chamber spaces.

6. Hammering device according to the claim 5, characterized in that during the impact the second chamber receiving the pressure fluid is expanding in the same proportion as the first chamber is getting smaller.

7. Hammering device according to the claim 5, characterized in that the gas, which is located in the chamber space can be moved into a chamber space with the help of a valve arrangement and the moving of the hammering piston and correspondingly can be returned into the chamber space.

8. Hammering device according to the claim 5, characterized in that gas spaces are adjusted inside the body, next to the chamber spaces being separated by the flange parts of the hammering element which gas spaces attenuate the empty impacts of the shaft bar and function as gas spaces which store hammering energy for the shaft bar.

* * * * *